US007075779B2

(12) United States Patent
Bothe et al.

(10) Patent No.: US 7,075,779 B2
(45) Date of Patent: Jul. 11, 2006

(54) VOLTAGE TRANSFORMER WITH HINGED HOUSING

(75) Inventors: Michael Bothe, Munster (DE); Kay Van Gen Hassend, Munster (DE); Michael Becks, Telgte (DE)

(73) Assignee: FRIWO Mobile Power GmbH, Ostbevern (DE)

( * ) Notice: Subject to any disclaimer, the term of this patent is extended or adjusted under 35 U.S.C. 154(b) by 293 days.

(21) Appl. No.: 10/730,376

(22) Filed: Dec. 8, 2003

(65) Prior Publication Data

US 2004/0201950 A1 Oct. 14, 2004

(30) Foreign Application Priority Data

Apr. 9, 2003 (EP) ..... 03008261

(51) Int. Cl.
*H01R 13/14* (2006.01)

(52) U.S. Cl. ..... 361/603; 361/144; 361/623; 439/131; 439/172

(58) Field of Classification Search ..... 361/144, 361/603, 623, 625, 636, 657; 363/71, 78–80, 363/20, 21.01, 24, 25; 307/39, 29, 11, 129, 307/38; 439/131, 135, 142, 352; 320/107, 320/111, 113, 115
See application file for complete search history.

(56) References Cited

U.S. PATENT DOCUMENTS 4,636,703 A 1/1987 Tohya et al.
4,677,411 A 6/1987 Hofmann et al.
5,628,641 A * 5/1997 Hahn ..... 439/131
6,057,610 A 5/2000 Nierescher
6,462,975 B1 10/2002 Cheng et al.
6,861,822 B1 * 3/2005 Wei ..... 320/111
2003/0137276 A1 * 7/2003 Lin ..... 320/115

FOREIGN PATENT DOCUMENTS

DE 197 04 130 A 8/1997
DE 202 11 132 10/2002
EP 000930673 A2 * 7/1999
EP 1060559 8/1999
JP 358007774 A * 1/1983
JP 60-230 375 B 11/1985
JP 64-34774 B 7/1989

(Continued)

*Primary Examiner*—Michael Datskovskiy
(74) *Attorney, Agent, or Firm*—Michael Best & Friedrich LLP

(57) ABSTRACT

The invention relates to a voltage transformer (1) including a housing (12) which encloses, at least partially, a mains plug (3, 4) connectable to a mains voltage source, a terminal plug (8) connectable to a terminal, and a voltage-transforming circuit, said housing (12) comprising a first housing component (2) and a second housing component (6) movably connected to said first housing component (2) by a guide means and implemented as a reception means (9) for receiving therein the terminal, and said voltage transformer (1) being adapted to be moved from a transport position to a charging position. In order to improve the handiness of the voltage transformer (1) during charging and, in particular, during transport, the present invention is so conceived that, at the transport position, the housing components (2, 6) have been moved relative to one another such that the space occupied at the transport position is smaller than that occupied at the charging position.

23 Claims, 1 Drawing Sheet

FOREIGN PATENT DOCUMENTS

Figure 1:
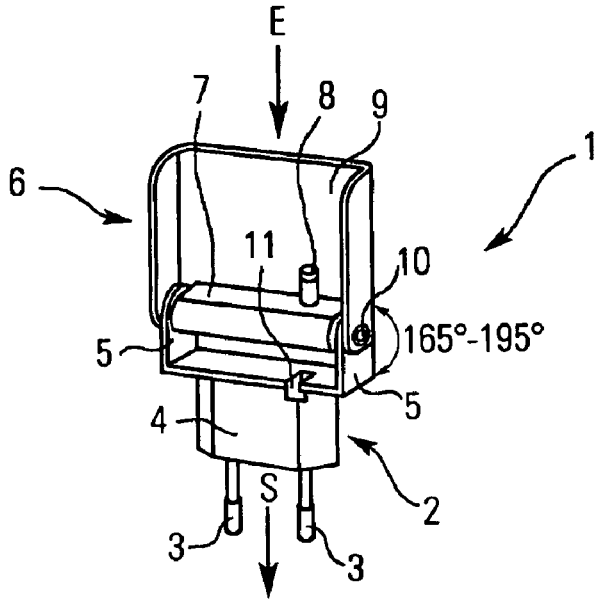

| | | | | |
|---|---|---|---|---|
| JP | 4-16608 | C | | 8/1997 |
| JP | 9-213 434 | B | | 8/1997 |
| JP | 02000152511 | A | * | 5/2000 |
| JP | 2000315529 | A | * | 11/2000 |
| JP | 2000324221 | A | * | 11/2000 |
| JP | 02001223032 | A | * | 8/2001 |
| JP | 2001-22 413 6 | B | | 8/2002 |
| JP | 02003100354 | A | * | 4/2003 |

* cited by examiner

VOLTAGE TRANSFORMER WITH HINGED HOUSING

The invention relates to a voltage transformer including a housing which encloses, at least partially, a mains plug connectable to a mains voltage source, a terminal plug connectable to a terminal, and a voltage-transforming circuit, said housing comprising a first housing component and a second housing component movably connected to said first housing component by a guide means and implemented as a reception means for receiving therein the terminal, and said voltage transformer being adapted to be moved from a transport position to a charging position.

Modern mobile terminals used in the field of communications and entertainment technology, in particular MP3 players, mobile phones, PDAs (Personal Digital Assistants) or the like, are provided with current-storing accumulator units so that they can be operated in a mains-independent manner. Every now and then, these mobile terminals must be connected to a mains voltage source for charging the accumulator units. Since the available mains voltage is different from the charging voltage required for charging the accumulator units, a voltage transformer must be used for transforming the mains voltage to the charging voltage. This voltage transformer must have a connection facility for connection to a mains voltage source and a further connection facility for connection to the mobile terminal to be charged.

The prior art discloses various voltage transformers for charging and also for supplying current to mobile terminals.

The most frequently used voltage transformers are plug-in power supply units which are connected to the terminal via a secondary cable. In the case of some voltage-transformers, a voltage-transforming circuit is integrated in the housing of the mains plug. In the prior art, the secondary side of this transformer circuit is connected to the terminal through a plug-in type cable.

This embodiment is disadvantageous insofar as major voltage losses may occur at the secondary side due to the length of the cable; such voltage losses are undesirable in the case of modern terminals. In order to eliminate this drawback, EP 1 060 559 B1 describes a device in which the transformer circuit defines a rigid structural unit with the terminal plug. The length of the secondary lines is kept as short as possible in this way. The structural unit is then connected to a mains voltage source through a cable on the primary side of the transformer circuit.

The voltage transformers known from the prior art are also problematic insofar as their structural shape is unhandy for the purpose of transport. Voltage transformers for mobile terminals are, like the terminals themselves, often transported so that the terminal can be charged at any time. Hence, a structural shape which can be transported easily is important. Although in U.S. Pat. No. 6,462,975 B1 attempts are made to improve the handiness of the voltage transformer by providing foldable mains plug pins, the success is only a rudimentary one, since due to the connection cable, the voltage transformer is still not very handy for the purpose of transport.

Furthermore, when the known voltage transformers are operated, the problem arises that there is no specific place where the terminal can be deposited. The terminal must be deposited somewhere close to a mains socket so that the voltage transformer can be connected.

An approach to a solution of the two above-mentioned problems is offered by DE 202 11 132 U1, which constitutes the closest prior art. This publication describes a portable charging means for a mobile phone in the case of which the power supply unit, the line, the plug and the connection for the mobile phone are combined so as to form one main body with a housing, said main body having on the upper surface thereof a connection onto which the mobile phone can be placed in a stable manner. From this charging position the portable charging means can be transferred to a transport position in said DE 202 11 132 U1; at said transport position, the housing of the portable charging means has, if necessary, attached thereto a separate protective cover so as to protect said charging means and so as to make it more easily portable. The described portable charging means remains, nevertheless, unhandy due to its size because its dimensions are increased still further by the protective cover attached at the transport position.

Taking into account this prior art, it is therefore the object of the present invention to improve the voltage transformers, which are known from the prior art, in such a way that their handiness will be improved during charging and, in particular, during transport.

In the case of the voltage transformer referred to at the beginning, the present invention achieves this object in that, at the transport position, the housing components have been moved relative to one another such that the space occupied at the transport position is smaller than that occupied at the charging position.

This solution according to the present invention has the advantage that the size of the voltage transformer at the transport position is substantially smaller than the size at the charging position. The voltage transformer can thus easily be accommodated in luggage and e.g. even be transported in a trouser pocket.

The performance of such an improved voltage transformer can be improved by various mutually independent further developments, which are each advantageous and which will be explained hereinbelow.

The guide means through which the second housing component is movably connected to the first housing component can be provided with locking positions in accordance with an advantageous further development. It is thus possible to define fixed positions of the first housing component relative to the second housing component, which can be suitable for different tasks and charging positions of the voltage transformer.

According to a structurally simple embodiment, the guide means between the first housing component and the second housing component can be implemented as a rotary guide means, whereby the two housing components can be moved to different angular positions relative to one another.

According to an advantageous further development, the second housing component can be implemented such that it will enclose the mains plug in the transport position and accommodate the terminal in the charging position. In the case of this embodiment, the second housing component serves as a protective casing for the first housing component and the mains plug, respectively. The second housing component can, in particular, cover mains plug pins of the mains plug so that these mains plug pins will be prevented from getting caught or from breaking off during transport. The voltage transformer can also be implemented such that, when occupying the transport position, it has essentially the shape of a rectangular parallelepiped so that it can easily be transported e.g. in the pockets of clothes. In addition, one further development allows the voltage transformer to be moved to a second charging position at which the housing components occupy positions relative to one another which are different from those of the first charging position. On the basis of the different charging positions, the voltage transformer can be adapted to different positions of mains sockets. For example, one charging position can be used for charging in a wall socket and the other charging position for charging in a table socket. Both charging positions can be fixed by the locking positions.

According to one embodiment, the reception means can be implemented in the form of a channel into which the terminal can be inserted in an insertion direction for the purpose of charging. When the voltage transformer is provided with a rotary guide means, the angle of the insertion direction relative to a plug-in direction, in which the mains plug is plugged into a mains socket, can be changed.

For example, the first housing component may, at the transport position, be folded into the second housing component, the angle between said housing components being then approx. 0°, and this will lead to an advantageous size of the voltage transformer for the purpose of transport. The insertion direction and the plug-in direction can be oriented parallel to one another in this case.

At the first charging position, the housing components can be positioned at an angle in the range of approx. 165° to 195°, preferably at an angle of approx. 180°, relative to one another, whereby the voltage transformer will be particularly suitable e.g. for charging in a table socket; the insertion direction and the plug-in direction can be oriented in parallel in this case. Furthermore, the housing components can, when occupying the second charging position, extend away from one another at an angle in the range of approx. 75° to 90°, preferably, however, at essentially right angles, whereby the voltage transformer will be particularly suitable e.g. for operation in a wall socket. The insertion direction and the plug-in direction can here be oriented essentially transversely to one another.

In accordance with a further improvement, the first housing component can be implemented such that it protectively encloses the terminal plug in the transport position and is adapted to be inserted into a mains socket in the charging position.

Furthermore, the guide means through which the first housing component and the second housing component are movably interconnected can transmit therethrough an electric current from the first to the second housing component. This embodiment is advantageous insofar as an e.g. externally extending additional cable can be dispensed with.

According to other advantageous further developments, the mains plug can be implemented in various forms so as to be adapted to country-specific mains sockets or e.g. to a socket in a motor vehicle. The voltage transformer according to the present invention can thus be used in many places.

Furthermore, the voltage-transforming circuit can be integrated in the first housing component, whereby a particular large amount of space will be saved.

In addition, the first housing component can have a fork-shaped structural design, the pivot points of the second housing component being arranged in the area of the fork ends. Due to the fork-shaped structural design, also broad terminals can be inserted in the second housing component implemented as a reception means. This will reduce the overall size of the voltage transformer.

In particular, it is possible to implement the second housing component independently of the first one and to adapt it to a great variety of terminal plugs. Hence, the invention can be used by many manufacturers of terminals, in which case only the second housing component will have to be replaced, whereas the first housing component can be used for the entire production line.

In the following, the present invention will be explained exemplarily, making reference to the drawings enclosed. The different features can be combined independently of one another, as has already been explained hereinbefore in connection with the individual advantageous embodiments.

Figure 2:
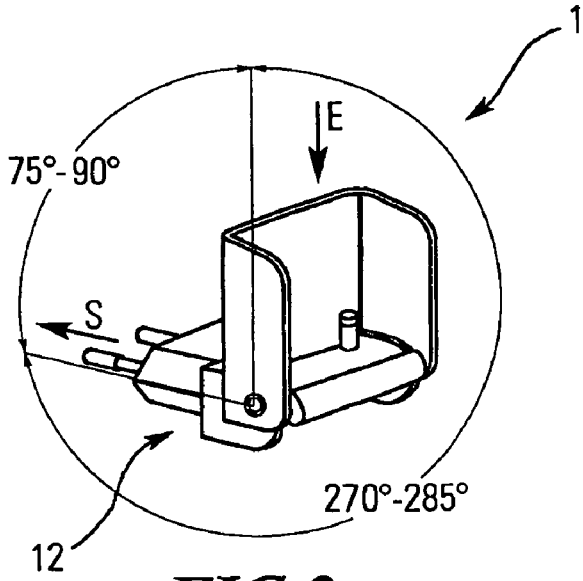
Figure 3:
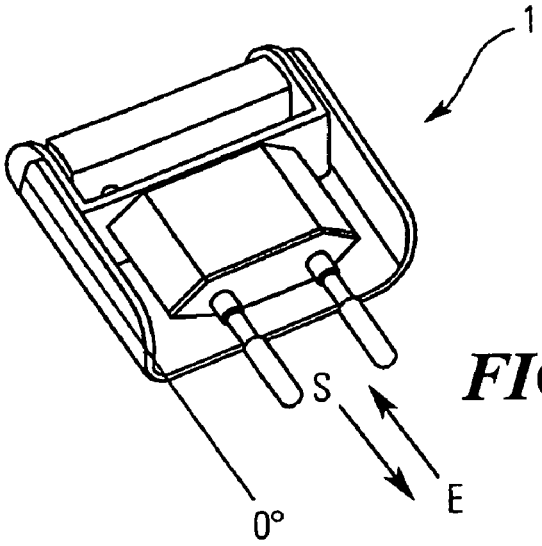

FIG. 1 schematically shows an embodiment of a voltage transformer according to the present invention at a first charging position;

FIG. 2 schematically shows the voltage transformer of FIG. 1 at a second charging position;

FIG. 3 shows the voltage transformer of FIG. 1 at a transport position.

To begin with, the general structural design of a voltage transformer 1 according to the present invention will be described with reference to FIG. 1.

The voltage transformer 1 comprises a first housing component 2 with two mains plug pins 3 for connection to a mains voltage source and with a body 4 which is here hexagonal in shape. The first housing component 2 defines a mains plug 3, 4 in the interior of which the voltage-transforming circuit (not shown), e.g. a transformer, is provided. The mains plug 3, 4 is adapted to be inserted into a mains socket in the plug-in direction S.

The mains plug comprising the mains plug pins 3 and the mains plug body 4 can have different forms, depending on the type of mains socket to which it should be adaptable. The form depicted in FIG. 1 shows e.g. a Euro mains plug of the type implemented for use in Europe. Other embodiments may e.g. be a US plug or a Chinese plug. Moreover, an embodiment with an earth contact in addition to the mains plug pins 3 is possible as well.

The first housing component 2 is provided with a guide means for connection to the second housing component 6. In FIG. 1, this guide means is exemplarily implemented as a rotary guide means 10 in the form of a hinge. The first housing component 2 is movably connected to the second housing component 6 by this rotary guide means 10. As is exemplarily shown in FIG. 1, the first housing component 2 is fork-shaped in the section following the mains plug body 4. The rotary guide means 10 is located at the fork ends 5 of the first housing component 2 and is provided with locking positions at which the housing components 2, 6 are fixed relative to one another.

The second housing component 6 comprises a body 7 which is provided with a guide means through which said body 7 of the second housing component 6 is movably connected to the first housing component 2. In FIG. 1, this guide means is exemplarily implemented as a rotary guide means 10. The body 7 has provided thereon the terminal plug 8 for connecting the terminal to the voltage transformer 1. In FIG. 1, said terminal plug 8 is exemplarily shown in the form of a coaxial plug which projects beyond the body 7. The terminal plug 8 can be implemented in different forms so that the voltage transformer 1 can be adapted to a great variety of different terminals. It follows that the voltage transformer 1 is adapted to be used by a great variety of manufacturers of terminals who provide their terminals with various connections.

The second housing component 6 additionally defines a reception means 9. The reception means 9 has the function of holdingly enclosing the terminal attached to the terminal plug. As can be seen in FIG. 1, the reception means 9 can be implemented as a channel so that a terminal can be inserted in the insertion direction E. The reception means 9 can have different forms, depending on the terminal in question. In FIG. 1, the reception means 9 is implemented as a thin-walled, U-shaped tray.

The second housing component 6 can be separated from the first housing component 2, whereby said second housing component 6 can be exchanged easily. This may be necessary especially in the case of wear of said second housing component 6. Furthermore, this also allows various embodiments of the second housing component 6 to be connected to the same first housing component 2, e.g. in cases in which said first housing component 2 is to be used for a different terminal.

In FIG. 1, the voltage transformer 1 is exemplarily shown at a first charging position. This first charging position is shown in FIG. 1 such that the first housing component 2 including the mains plug 3, 4 is in alignment with the second housing component 6 including the terminal plug 8 at an angle in the range of approx. 165° to 195°, preferably, however, approx. 180°, relative to the rotary guide means 10. The insertion direction E and the plug-in direction S are essentially parallel to one another. At the position shown, the voltage transformer 1 can be operated e.g. in a horizontally extending mains socket, a so-called table socket.

In FIG. 2, the voltage transformer 1 is exemplarily shown at a second charging position. At this second charging position, the voltage transformer 1 can be inserted into a mains socket whose position deviates from that of the first charging position. Also at this charging position, the second housing component 6 occupies a position suitable for receiving the terminal. At the second charging position, which is exemplarily shown in FIG. 2, the first housing component 2 and the second housing component 6 are arranged at an angle of approx. 750° to 90°, preferably, however, at substantially right angles, to one another, the insertion direction E and the plug-in direction S being oriented essentially transversely to one another. At the second charging position, the voltage transformer 1 including the mains plug 3, 4 can be inserted in a vertically extending mains socket, a so-called wall socket. At this position, the terminal can be attached to the terminal plug 8 in a vertical orientation and is then held by the reception means 9. The orientation of the two housing components 2, 6 at one of the charging positions can deviate from the approximately right-angled or aligned orientation so that an inclined display of the terminal, e.g. of a mobile phone, can be read more easily.

In FIG. 3, the voltage transformer 1 is exemplarily shown at a transport position. At this position, the two housing components 2, 6 are positioned relative to one another such that they occupy an ideal voltage-transformer transport position at which the space occupied by the voltage transformer 1 is as small as possible. In the example shown in FIG. 3, the first housing component 2 and the second housing component 6 are positioned at an angle of approx. 0° to one another and are therefore folded into one another. The insertion direction E and the plug-in direction S extend essentially parallel to one another. At this position, the dimensions of the voltage transformer 1 are reduced, said voltage transformer 1 having essentially the shape of a rectangular parallelepiped; the mains plug pins do not project much beyond the second housing component 6 or they may also extend fully within said second housing component 6. The external shape of the voltage transformer 1 is therefore particularly advantageous for the purpose of transport.

Due to the fact that the reception means 9 is U-shaped in FIG. 1, it protectively encloses the first housing component 2 in a space-saving manner.

In the exemplary representation shown in FIG. 3, the terminal plug 8 is protected by the first housing component 2 in the transport position. Said terminal plug 8 is very sensitive and, if it is not protected, it may easily break off during transport. In the case of the voltage transformer 1 shown exemplarily in FIG. 3, such protection is achieved by a recess 11 in the first housing component 2. This recess 11 protectively encloses the terminal plug 8 in the transport position.

The two housing components 2 and 6 are connected by the rotary guide means 10 so as to form one housing 12, and at the transport position and the charging positions, respectively, they are fixed relative to one another by locking positions.

The rotary guide means 10 provided between the first housing component 2 and the second housing component 6 transmits, at least at the charging positions, the electric current flowing from the mains plug 3 via the voltage-transforming circuit (not shown) to the terminal plug 8. This can be done by electrically conductive wiping contact disks (not shown) on either side of the rotary guide means 10. An additional cable outside of the voltage transformer is thus not necessary. This will avoid the risk of cable break, which would otherwise cause a failure of the voltage transformer 1.

The invention claimed is:

1. A voltage transformer comprising: a housing including a mains plug connectable to a mains voltage source, a terminal plug connectable to a terminal, and a voltage transformer circuit, the housing comprising a first housing component and a second housing component movably connected to the first housing component by a guide means and implemented as a reception means for receiving therein the terminal, and the voltage transformer adapted to move from a transport position to a first charging position, wherein, at the transport position, the housing components have been moved relative to one another such that the space occupied at the transport position is smaller than that occupied at the first charging position, wherein the voltage transformer is adapted to be moved to a second charging position which is different from the first charging position and the transport position.

2. A voltage transformer according to claim 1, wherein the guide means through which the second housing component is movably connected to the first housing component is implemented as a rotary guide means.

3. A voltage transformer according to claim 1, wherein the second housing component is implemented as a protective casing which encloses the mains plug, at least in certain sections thereof, in the transport position.

4. A voltage transformer according to claim 1, wherein the voltage transformer is implemented such that, in the transport position, the first housing component is folded onto the second housing component.

5. A voltage transformer according to claim 1, wherein the mains plug main plug and the terminal plug are implemented such that they are in alignment with one another in the first charging position.

6. A voltage transformer according to claim 1, wherein in the second charging position, the mains plug extends away from the terminal plug at an angle of about 90 degrees.

7. A voltage transformer comprising: a housing including a mains plug connectable to a mains voltage source, a terminal plug connectable to a terminal, and a voltage transformer circuit, the housing comprising a first housing component and a second housing component movably connected to the first housing component by a guide means and implemented as a reception means for receiving therein the terminal, and the voltage transformer adapted to move from a transport position to a first charging position, wherein, at the transport position, the housing components have been moved relative to one another such that the space occupied at the transport position is smaller than that occupied at the first charging position, wherein the first housing component is implemented such that it encloses the terminal plug in the transport position.

8. A voltage transformer according to claim 1, wherein the mains plug is interchangeable with the voltage transformer so as to be compatible with different, country-specific mains sockets.

9. A voltage transformer comprising: a housing including a mains plug connectable to a mains voltage source, a terminal plug connectable to a terminal, and a voltage transformer circuit, the housing comprising a first housing component and a second housing component movably connected to the first housing component by a guide means and implemented as a reception means for receiving therein the terminal, and the voltage transformer adapted to move from a transport position to a first charging position, wherein, at the transport position, the housing components have been moved relative to one another such that the space occupied at the transport position is smaller than that occupied at the first charging position, wherein the voltage transformer circuit is integrated in the first housing component.

10. A voltage transformer comprising: a housing including a mains plug connectable to a mains voltage source, a terminal plug connectable to a terminal, and a voltage transformer circuit, the housing comprising a first housing component and a second housing component movably connected to the first housing component by a guide means and implemented as a reception means for receiving therein the terminal, and the voltage transformer adapted to move from a transport position to a first charging position, wherein, at the transport position, the housing components have been moved relative to one another such that the space occupied at the transport position is smaller than that occupied at the first charging position, wherein the first housing component has a fork-shaped structural design and is provided with a rotary guide means at the fork ends.

11. A voltage transformer according to claim 1, wherein the terminal plug is replaceably arranged on the voltage transformer.

12. A voltage transformer comprising: a housing including a mains plug connectable to a mains voltage source, a terminal plug connectable to a terminal, and a voltage transformer circuit, the housing comprising a first housing component and a second housing component movably connected to the first housing component by a guide means and implemented as a reception means for receiving therein the terminal, and the voltage transformer adapted to move from a transport position to a first charging position, wherein, at the transport position, the housing components have been moved relative to one another such that the space occupied at the transport position is smaller than that occupied at the first charging position, wherein at the first charging position, an insertion direction, in which a terminal can be inserted to the reception means and a plug-in direction, in which the main plug is connectable to the main voltage source, extend parallel to one another.

13. A voltage transformer according to claim 1, wherein at a second charging position, an insertion direction, in which a terminal can be inserted to the reception means and a plug-in direction, in which the main plug is connectable to the main voltage source, extend transverse to one another.

14. A voltage transformer according to claim 1, wherein at the transport position, an insertion direction, in which a terminal can be inserted to the reception means and a plug-in direction, in which the main plug is connectable to the main voltage source, extend parallel to one another.

15. A voltage transformer according to claim 1, wherein the first housing component is implemented such that it encloses the terminal plug in the transport position.

16. A voltage transformer according to claim 1, wherein the voltage transformer circuit is integrated in the first housing component.

17. A voltage transformer according to claim 1, wherein the first housing component has a fork-shaped structural design and is provided with a rotary guide means at the fork ends.

18. A voltage transformer according to claim 1, wherein at the first charging position, an insertion direction, in which a terminal can be inserted to the reception means and a plug-in direction, in which the main plug is connectable to the main voltage source, extend parallel to one another.

19. A voltage transformer according to claim 7, wherein the second housing component is implemented as a protective casing which encloses the mains plug, at least in certain sections thereof, in the transport position.

20. A voltage transformer according to claim 7, wherein the voltage transformer is implemented such that, in the transport position, the first housing component is folded onto the second housing component.

21. A voltage transformer according to claim 7, wherein the first housing component has a fork-shaped structural design and is provided with a rotary guide means at the fork ends.

22. A voltage transformer according to claim 12, wherein the voltage transformer is adapted to be moved to a second charging position which is different from the first charging position and the transport position.

23. A voltage transformer according to claim 12, wherein at a second charging position, an insertion direction, in which a terminal can be inserted to the reception means and a plug-in direction, in which the main plug is connectable to the main voltage source, extend transverse to one another.

* * * * *